US009728149B2

(12) United States Patent
Byun et al.

(10) Patent No.: US 9,728,149 B2
(45) Date of Patent: Aug. 8, 2017

(54) DISPLAY PANEL AND DISPLAY DEVICE INCLUDING THE SAME

(71) Applicant: ELECTRONICS AND TELECOMMUNICATIONS RESEARCH INSTITUTE, Daejeon (KR)

(72) Inventors: Chunwon Byun, Daejeon (KR); Jae-Eun Pi, Daejeon (KR); Kyoung Ik Cho, Daejeon (KR); Hye Yong Chu, Daejeon (KR); Chi-Sun Hwang, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 10 days.

(21) Appl. No.: 15/007,856

(22) Filed: Jan. 27, 2016

(65) Prior Publication Data

US 2016/0267827 A1 Sep. 15, 2016

(30) Foreign Application Priority Data

Mar. 10, 2015 (KR) ..... 10-2015-0033297

(51) Int. Cl.
*G09G 3/36* (2006.01)
*G09G 3/3233* (2016.01)

(52) U.S. Cl.
CPC ..... *G09G 3/3648* (2013.01); *G09G 3/3233* (2013.01); *G09G 2300/046* (2013.01); *G09G 2300/0842* (2013.01)

(58) Field of Classification Search
None
See application file for complete search history.

(56) References Cited

U.S. PATENT DOCUMENTS

| | | | |
|---|---|---|---|
| 7,170,506 | B2 | 1/2007 | Eldon et al. |
| 7,248,235 | B2 | 7/2007 | Fujii et al. |
| 7,440,071 | B2 | 10/2008 | Hsieh et al. |
| 7,482,185 | B2 | 1/2009 | Yeh et al. |
| 7,576,736 | B2 | 8/2009 | Yeh et al. |
| 7,599,025 | B2 | 10/2009 | Yeh et al. |

(Continued)

FOREIGN PATENT DOCUMENTS

| | | | |
|---|---|---|---|
| JP | 4964605 | B2 | 4/2012 |
| KR | 10-0947560 | B1 | 3/2010 |
| WO | WO 2007/041150 | A1 | 4/2007 |

*Primary Examiner* — Nalini Mummalaneni
*Assistant Examiner* — Christopher Kohlman

(57) ABSTRACT

A display panel includes pixels connected to each of gate lines and data lines. Each of the pixels includes a first transistor connected between a corresponding data line among the data lines and a first node and configured to deliver a data signal of the corresponding data line to the first node in response to an input signal received through a corresponding gate line among the gate lines, a reflective element circuit connected to the first node, and configured to implement the reflective mode in response to a signal of the first node when a first mode selection signal indicates a reflective mode, an emissive element circuit connected to a second node, and configured to implement the emissive mode in response to the signal of the first node when the mode selection mode indicates an emissive mode.

9 Claims, 15 Drawing Sheets

(56) References Cited

U.S. PATENT DOCUMENTS

| | | | | |
|---|---|---|---|---|
| 2003/0052869 | A1* | 3/2003 | Fujii | G02F 1/133555 345/204 |
| 2003/0193457 | A1* | 10/2003 | Wang | G09G 3/20 345/84 |
| 2007/0032000 | A1* | 2/2007 | Yeh | G02F 1/133555 438/149 |
| 2007/0242031 | A1* | 10/2007 | Kimura | G02F 1/133603 345/102 |
| 2009/0244683 | A1* | 10/2009 | Lan | G02B 26/001 359/263 |
| 2011/0292095 | A1* | 12/2011 | Yoshida | G02F 1/13624 345/690 |
| 2012/0293428 | A1* | 11/2012 | Yan | H01L 27/3232 345/173 |
| 2013/0063409 | A1* | 3/2013 | Chiu | G09G 3/348 345/211 |
| 2013/0208022 | A1 | 8/2013 | Ryu et al. | |
| 2014/0042475 | A1 | 2/2014 | Park et al. | |

* cited by examiner

DISPLAY PANEL AND DISPLAY DEVICE INCLUDING THE SAME

CROSS-REFERENCE TO RELATED APPLICATIONS

The present claims priority under 35 U.S.C. §119 of Korean Patent Application No. 10-2015-0033297, filed on Mar. 10, 2015, the entire contents of which are hereby incorporated by reference.

TECHNICAL FIELD

The present disclosure herein relates to a display device, and more particularly, to a display device including an emissive element and a reflective element and a driving method thereof.

DESCRIPTION OF THE RELATED ART

With the rapid development of information and communications industry, the uses of display devices are increased. Recently, display devices that satisfy the low-power, light-weight, thin, and high resolution conditions are required. In order to meet such demands, liquid crystal display devices or organic light emitting display devices using organic light emitting properties are under development.

Organic light emitting display devices are the next generation display devices having self-emitting characteristics. Organic light emitting display devices shows excellent performance in terms of viewing angle, contrast, response speed, and power consumption in comparison to liquid crystal display devices. Additionally, since organic light emitting display devices do not require back lights, it is possible to manufacture them to be light and thin.

Such organic light emitting display devices show excellent contrast performance in comparison to liquid crystal display devices. However, when an external light source of more than a predetermined intensity is incident, the visibility of organic light emitting display devices may be deteriorated. In order to improve the visibility, suggested is a reflective-emissive composite display device implemented by combining an organic light emitting mode and a reflective liquid crystal mode.

SUMMARY

The present disclosure provides a display device for efficiently selecting and driving a reflective element and an emissive element according to an external illumination environment and a driving method thereof An embodiment may provide a display panel comprising pixels connected to gate lines and data lines, wherein each of the pixels comprises: a first transistor connected between a corresponding data line among the data lines and a first node, and configured to deliver a data signal of the corresponding data line to the first node in response to an input signal received through a corresponding gate line among the gate lines, a reflective element circuit connected to the first node, and configured to implement a reflective mode in response to the delivered data signal of the first node when a first mode selection signal indicates the reflective mode, an emissive element circuit connected to a second node, and configured to implement an emissive mode in response to the delivered data signal of the first node when a second mode selection signal indicates the emissive mode, and a capacitor, one end of the capacitor being connected to the first node and an other end of the capacitor being applied with a control signal, and wherein the reflective element circuit comprises: a second transistor connected between the first node and the second node, and configured to operate in response to the first mode selection signal, and a reflective element, one end of the reflective element being connected to the second node and an other end of the reflective element being supplied with the control signal.

In an embodiment, the emissive element circuit may include: a third transistor connected to the first node, one end of the third transistor being configured to receive a power voltage, the power voltage being delivered from one end of the third transistor to an other end of the third transistor in response to the delivered data signal of the first node, a fourth transistor connected to the second node, and configured to apply the control signal to the second node in response to the second mode selection signal and a fifth transistor connected to the other end of the third transistor, and configured to connect the other end of the third transistor to an emissive element in response to the second mode selection signal.

In an embodiment, when the first transistor is turned on, the capacitor is charged by a voltage difference between the delivered data signal of the first node and the control signal, and maintains the delivered data signal of the first node when the first transistor is turned off.

In an embodiment, the emissive element circuit may include: a third transistor configured to receive a power voltage, the power voltage being delivered from one end of the third transistor to an other end of the third transistor in response to the second mode selection signal, a fourth transistor connected to the second node and configured to apply the control signal to the second mode in response to the second mode selection signal, and a fifth transistor connected to the other end of the third transistor and configured to connect the other end of the third transistor to an emissive element in response to the delivered data signal of the first node.

An embodiment may provide a display panel comprising pixels connected gate lines and data lines, wherein each of the pixels comprises: a first transistor connected between a corresponding data line among the data lines and a first node and configured to deliver a data signal of the corresponding data line to the first node in response to an input signal received through a corresponding gate line among the gate lines, a reflective element circuit connected to the first node, and configured to implement a reflective mode in response to the delivered data signal of the first node when a first mode selection signal indicates the reflective mode, an emissive element circuit connected to a second node, and configured to implement an emissive mode in response to the delivered data signal of the first node when a second mode selection signal indicates the emissive mode, and a capacitor, one end of the capacitor being supplied with a power voltage and an other end of the capacitor being connected to the first node, wherein the reflective element circuit comprises: a second transistor connected between the first node and the second node, and configured to operate in response to the first mode selection signal and a reflective element one end of the reflective element being connected to the second node and an other end of the reflective element being supplied with a common voltage.

In an embodiment, the emissive element circuit may include: a third transistor configured to receive a power voltage, the power voltage being delivered from one end of the third transistor to an other end of the third transistor in response to the second mode selection signal, a fourth transistor configured to apply the power voltage to the second node in response to the second mode selection signal and a fifth transistor connected to the other end of the third transistor and configured to connect the other end of the third transistor to an emissive element in response to the delivered data signal of the first node.

In an embodiment, when the first transistor is turned on, the capacitor is charged by a voltage difference between the power voltage and a delivered data signal of the first node, and maintains the delivered data signal of the first node when the first transistor is turned off.

In an embodiment, a phase of the second mode selection signal is opposite to a phase of the first mode selection signal.

An embodiment may provide display device comprising: a display panel comprising pixels connected to gate lines and data lines, a gate driving circuit connected to the display panel and the gate lines and configured to provide a gate signal to the pixels, and a data driving circuit connected to the display panel and the data lines and configured to provide a data signal to the pixels, wherein each of the pixels comprises: a first transistor connected between a corresponding data line among the data lines and a first node and configured to deliver a data signal of the corresponding data line to the first node in response to an input signal received through a corresponding gate line among the gate lines, a reflective element circuit connected to the first node, and configured to implement a reflective mode in response to the delivered data signal of the first node when a mode selection signal indicates the reflective mode, an emissive element circuit connected to a second node, and configured to implement an emissive mode in response to the delivered data signal of the first node when the mode selection mode indicates the emissive mode, and a capacitor, one end of the capacitor being connected to the first node and an other end of the capacitor being applied with a control signal, and wherein the reflective element circuit comprises: a second transistor connected between the first node and the second node, and configured to operate in response to the first mode selection signal; and a reflective element, one end of the reflective element being connected to the second node and an other end of the reflective element being supplied with the control signal.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF EMBODIMENTS

Figure 1:
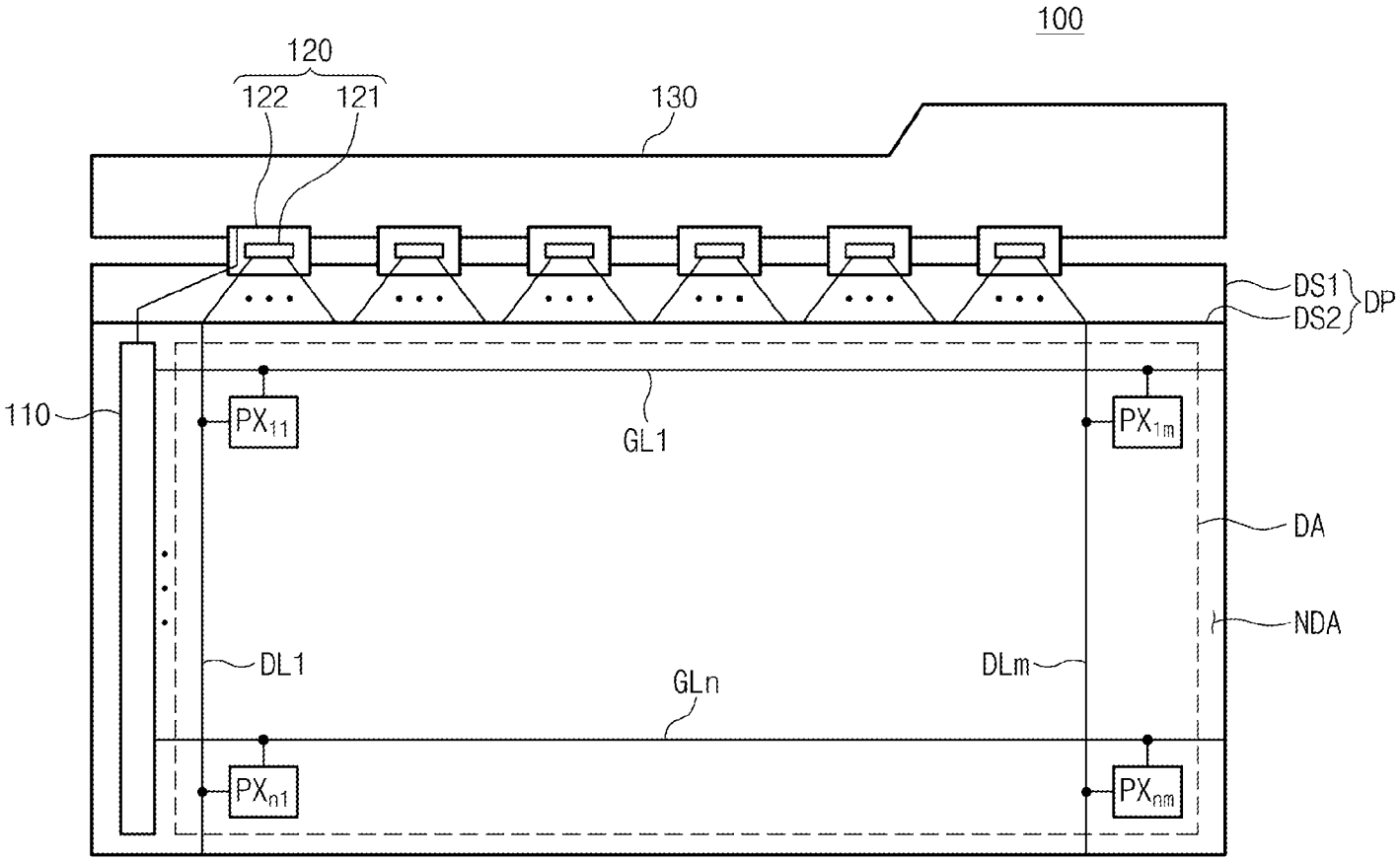
FIG. 1 is a block diagram illustrating a sensor device according to an embodiment.

Example embodiments are described in more detail with reference to the accompanying drawings. Various modifications are possible in various embodiments of the inventive concept and specific embodiments are illustrated in drawings and related detailed descriptions are listed. However, this does not limit various embodiments of the inventive concept to a specific embodiment and it should be understood that the inventive concept covers all the modifications, equivalents, and/or replacements of this disclosure provided they come within the scope of the appended claims and their equivalents. Like reference numerals refer to like elements throughout the drawings. In the accompanying drawings, the dimensions of structures are enlarged than they actually are for the clarity of the inventive concept. It will be understood that the terms "first" and "second" are used herein to describe various components but these components should not be limited by these terms. These terms are used only to distinguish one component from other components. For example, a first component may be referred to as a second component and vice versa without departing from the scope of the inventive concept. The terms of a singular form may include plural forms unless they have a clearly different meaning in the context.

Additionally, in various embodiments of the inventive concept, the term "include," "comprise," "including," or "comprising," specifies a property, a region, a fixed number, a step, a process, an element and/or a component but does not exclude other properties, regions, fixed numbers, steps, processes, elements and/or components. Additionally, it will be understood that when a portion such as a layer, a film, an area, and a plate is referred to as being 'on' another portion, it can be directly on the other portion, or an intervening portion can also be present. On the other hand, it will be understood that when a portion such as a layer, a film, an area, and a plate is referred to as being 'below' another portion, it can be directly below the other portion, or an intervening portion can also be present.

FIG. 1 is a block diagram illustrating a display device according to an embodiment. Referring to FIG. 1, a display device 100 may include a display panel DP, a gate driving circuit 110, a data driving circuit 120, and a circuit board 130.

The display panel DP may include a first substrate DS1 and a second substrate DS2. A plurality of gate lines GL1 to GLn and a plurality of data lines DL1 to DLm intersecting the plurality of gate lines GL1 to GLn are disposed on the first substrate DS1 of the display panel DP. The gate lines GL1 to GLn are connected to the gate driving circuit 110 to receive sequential gate signals. The plurality of data lines DL1 to DLm may be connected to the data driving circuit 120 to receive data signals (or data voltages) in analog form.

The second substrate DS2 may selectively implement a reflective mode and an emissive mode. Exemplarily, the second substrate DS2 may be configured with a liquid crystal display panel and an organic light emitting display panel. The second substrate DS2 may be divided into a display area DA formed of a plurality of pixels PX11 to PXnm and a non-display area NDA surrounding the display area DA. The pixels PX11 to PXnm of the second substrate DS2 will be described in detail with reference to FIGS. 2 to 13.

The plurality of pixels PX11 to PXnm are respectively connected to corresponding gate lines among the plurality of gate lines GL1 to GLn and corresponding data lines among the plurality of data lines DL1 to DLm.

The gate driving circuit 110 and the plurality of pixels PX11 to PXnm may be formed simultaneously through a thin film process. For example, the gate driving circuit 110 may be mounted in an organosilicate glass (OSG) form in the non-display area NDA.

Referring to FIG. 1, the gate driving circuit 110 is connected to the left ends of the gate lines GL1 to GLn but the inventive concept is not limited thereto. The display device 100 may include two gate driving circuits. One of the two gate driving circuits may be connected to the left ends of the plurality of gate lines GL1 to GLn and the other one may be connected to the right ends of the plurality of gate lines GL1 to GLn. Exemplarily, one of the two gate driving circuits may be connected to odd gate lines and the other one may be connected to even gate lines.

The data driving circuit 120 may receive data signals from a timing controller (not shown) mounted on the circuit board 130 and may generate analog data signals corresponding to data signals. Then, the data driving circuit 120 may receive control signals for controlling the pixels PX11 to PXnm from a timing controller (not shown). The control signals are signals for controlling a reflective mode and an emissive mode of the pixels PX11 to PXnm. The data driving circuit 120 generates analog control signals.

The data driving circuit 120 may include a driving chip 121 and a flexible circuit board 122 mounting the driving chip 121. The driving chip 121 and the flexible circuit board 122 may be provided in plurality. The flexible circuit board 122 connects the circuit board 130 and the first substrate DS1 electrically. The driving chip 121 provides data signals to corresponding data lines DL1 to DLm, respectively.

FIG. 1 illustrates a Tape Carrier Package (TCP) type data driving circuit 120 exemplarily. However, the data driving circuit 120 may be mounted on the first substrate DS1 through a Chip On Glass (COG) method.

Figure 2:
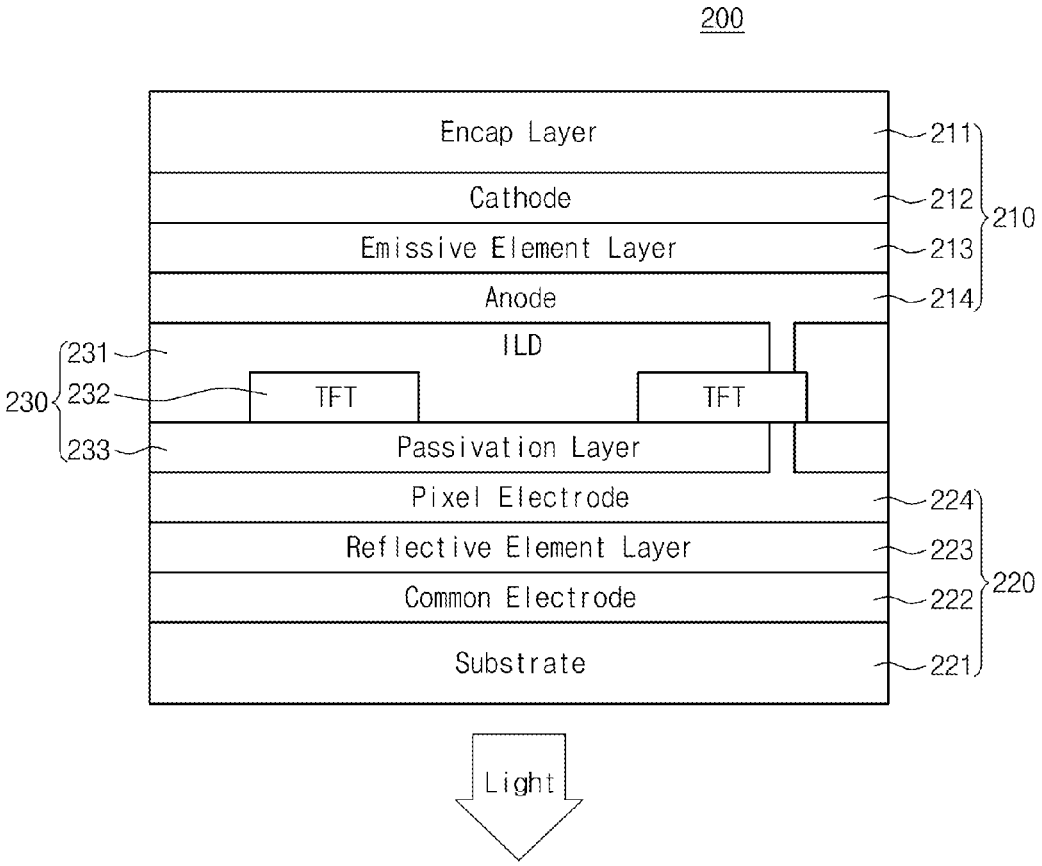
FIG. 2 is a sectional view illustrating a structure of a pixel according to an embodiment.

FIG. 2 is a sectional view illustrating a structure of a pixel according to an embodiment. Referring to FIG. 2, a pixel 200 shows a structure of the pixels PX11 to PXnm of FIG. 1.

An emissive element part 210 may include an encapsulation layer 211, a cathode electrode (or a cathode configuration layer) 212, an emissive element layer, and an anode electrode 214. The encapsulation layer 211 may be formed of an insulating substrate. For example, the encapsulation layer 211 may be formed in a glass substrate, plastic substrate, or thin film form. Since the emissive element part 210 is not a display part of the pixel 200, the encapsulation layer 211 may be formed of an opaque material.

The cathode electrode 212 and the anode electrode 214 may be electrodes for driving the emissive element layer 213. When driving the reflective element 223, the cathode electrode 212 may be used as a reflective plate. For example, the cathode electrode 212 may be formed of Ca, Mg, Al, or an alloy thereof. Since the light generated from the emissive element layer 213 penetrate the anode electrode 214, the anode electrode 214 may be formed of a transparent material. For example, the anode electrode 214 may be formed of an Indium Tin Oxide ((ITO), an Indium Zinc Oxide (IZO), or a Transparent Conductive Oxide (TCO).

The emissive element layer 213 may include an emissive element. The emissive element may be an element for emitting light by the current supplied through the cathode electrode 212 and the anode electrode 214. For example, the emissive element may be an organic light emitting element. The emissive element layer 213 may be formed through a method such as deposition, spin coating, roller coating, or ink-jet.

A reflective element part 220 may include a substrate 221, a substrate electrode 222, a reflective element layer 223, and a pixel electrode 224. The substrate 221 may be a substrate at the side of the display surface of the pixel 200. The substrate 221 may be formed of an insulating substrate. For example, the substrate 221 may be formed of a glass substrate or a plastic substrate. The substrate electrode 222 and the pixel anode electrode 224 may be formed of an ITO, an IZO, or a TCO. The substrate electrode 222 and the pixel electrode 224 are electrodes for driving the reflective element layer 223.

The reflective element layer 223 may be formed between the substrate electrode 222 and the pixel electrode 224. The reflective element layer 223 may be formed of a reflective element. For example, the reflective element layer 223 may be formed of a Nematic, Smectic, or Cholesteric liquid crystal material. The Cholesteric liquid crystal material has a property that reflects light according to voltage. Accordingly, when the reflective device layer 223 is formed of the Cholesteric liquid crystal material, the pixel 200 may use the reflective element layer 223 as a reflective plate. Additionally, the reflective element layer 223 may adjust the reflectance and transmittance of light. The light transmitted through the reflective element layer 223 may be reflected by the cathode configuration layer 212 of the emissive element part 210.

The reflective element part 230 may include transistors for driving the emissive element layer 213 and the reflective element layer 223. For example, a thin film transistor 232 may be formed of a silicon thin film transistor or an oxide thin film transistor. The thin film transistor may be deposited and formed on an insulating layer 233. The insulating layer 233 may be formed of a transparent insulating material. An interlayer insulating layer 231 may serve as to separate the thin film transistor 232 from the anode electrode 214. For example, the interlayer insulating layer 231 may be formed of a transparent plastic insulating layer or a glass insulating layer.

Layers of the pixel 200 may be connected to each other through a via (not shown). For example, the via may be formed of the ITO, the IZO, or the TCO. All layers of the pixels 200 except for a reflective plate may be formed of a transparent material. Accordingly, the aperture ratio and reflectance of a display part of the pixel 200 may be improved.

Figure 3:
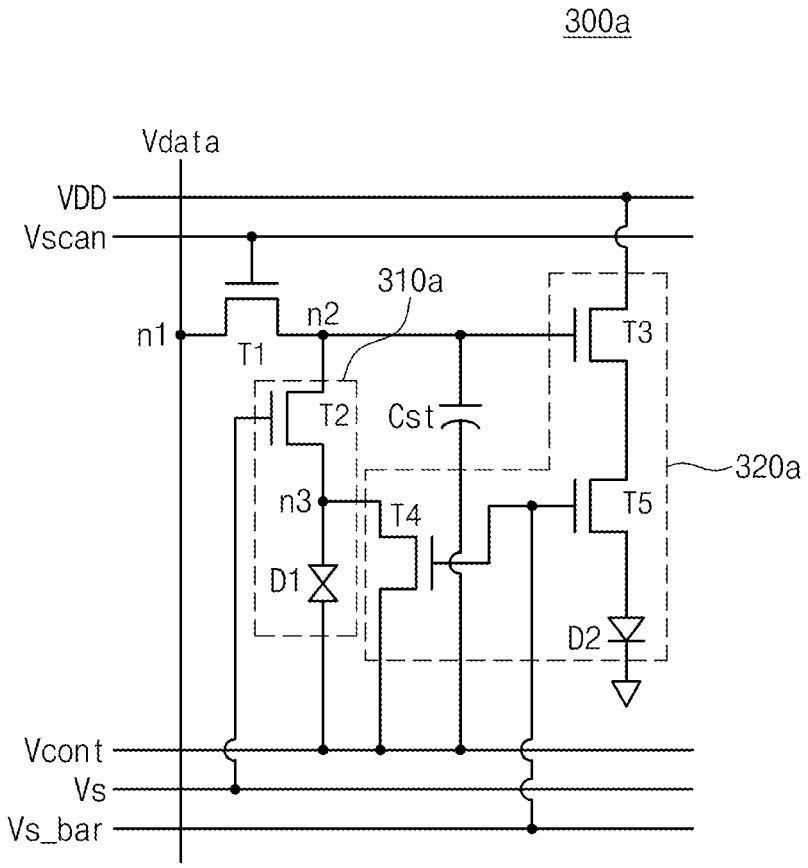
FIG. 3 is a circuit diagram illustrating a pixel of FIG. 1 in detail according to an embodiment.

FIG. 3 is a circuit diagram illustrating a pixel of FIG. 1 in detail according to an embodiment. Referring to FIGS. 1 and 3, the pixels PX11 to PXnm of FIG. 1 may have the same structure as a pixel 300*a* of FIG. 3. FIG. 3 exemplarily illustrates one pixel 300*a* among the pixels PX11 to PXnm.

Referring to FIG. 3, the pixel 300*a* may include a reflective element circuit 310*a* and an emissive element circuit 320*a*. The pixel 300*a* may include first to fifth transistors T1 to T5. For example, the transistors T1 to T5 are NMOS transistors. However, the inventive concept is not limited thereto.

The first transistor T1 may be a transistor for driving the pixel 300*a*. The first transistor T1 is connected between a first node n1 and a second node n2. According to a scan signal Vscan applied to the gate terminal of the first transistor T1, the first transistor T1 may deliver a data signal Vdata applied to the first node n1 to a reflective element circuit 310*a* or an emissive element circuit 320*a*, which is connected to the second node n2.

The reflective element circuit 310*a* may include a second transistor T2 and a reflective element D1. The second transistor T2 may be connected between the second node n2 and a third node n3. Then, one end of the reflective element D1 is connected to the third node n3 and a third control signal Vcont is applied to the other end. According to a first control signal Vs applied to the gate terminal of the second transistor T2, a data signal Vdata may be delivered to the reflective element D1.

The emissive element circuit 320*a* may include third to fifth transistors T3 to T5 and an emissive element D2. According to a data signal Vdata applied to the gate terminal of the third transistor T3, a power voltage VDD may be delivered to the fifth transistor T5. The forth transistor T4 may maintain voltages at the both ends of the reflective element D1 to be the same according to a third control signal Vs_bar applied to the gate terminal. Accordingly, a malfunction of the reflective element D1 may be prevented. The fifth transistor T5 may deliver the power voltage VDD to the emissive element D2 according to the third control signal Vs_bar applied to the gate terminal.

A capacitor Cst is connected to the second node n2. When the emissive element circuit 320*a* is driven, the capacitor Cst may allow a voltage applied to a gate of the third transistor T3 to be constant. A detailed driving method will be described with reference to FIGS. 4 to 8.

Figure 4:
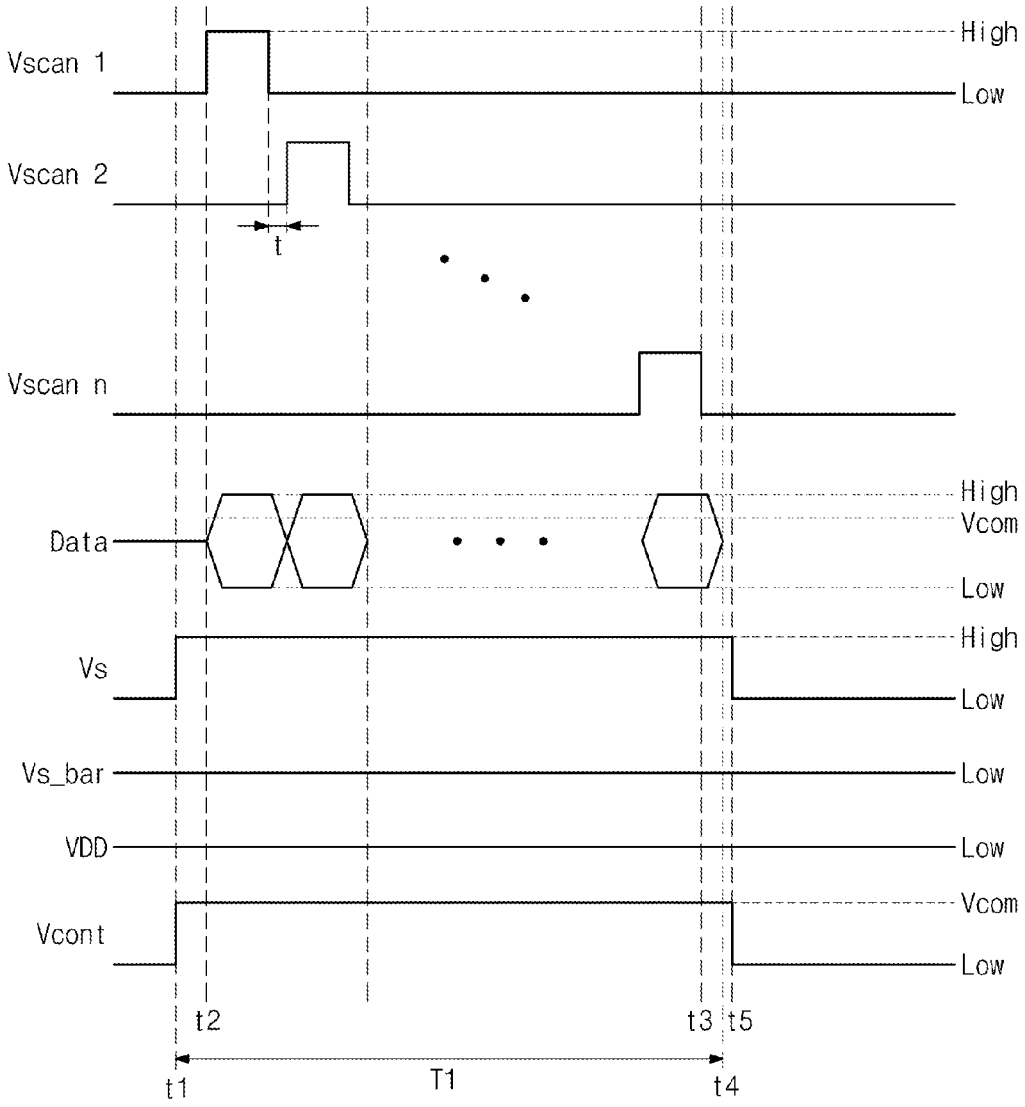
FIG. 4 is a timing diagram illustrating a signal applied to a pixel in order to implement a reflective mode according to an embodiment.
Figure 5:
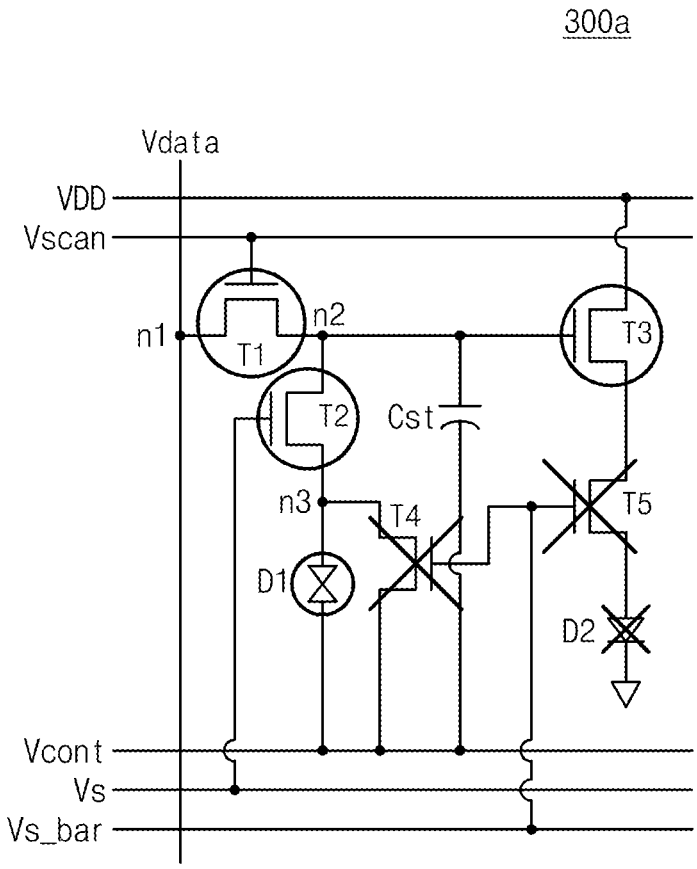
FIG. 5 is a circuit diagram illustrating an operation of a reflective element in a pixel of FIG. 3.

FIG. 4 is a timing diagram illustrating a signal applied to a pixel in order to implement a reflective mode according to an embodiment. FIG. 5 is a circuit diagram illustrating an operation of a reflective element in a pixel of FIG. 3.

Referring to FIGS. 4 and 5, a pixel 300*a* may drive a reflective element circuit 310*a* in a T1 section. At a first time t1, a first control signal Vs of a high level may be applied to the gate terminal of a second transistor T2. Then, a second control signal Vcont of a high level may be applied to one end of a capacitor Cst. At this point, the second control signal Vcont may rise to a common voltage level. The second transistor T2 is turned on by the first control signal Vs.

From a second time t2, scan signals Vscan 1 to Vscan n of a high level may be applied through the gate lines GL1 to GLn. Accordingly, the scan signals Vscan 1 to Vscan n may be sequentially applied to the gate terminal of the first transistor T1 through the gate lines GL1 to GLn of the pixels PX11 to PXnm. The scan signals Vscan 1 to Vscan n may be sequentially applied at an interval of a predetermined time t. The scan signals Vscan 1 to Vscan n may be sequentially applied until a third time t3. When the first transistor T1 is turned on by the scan signals Vscan 1 to Vscan n, a data signal data may be sequentially applied through the data lines DL1 to DLm. The data signal data may be applied in different levels to each of the data lines DL1 to DLm. The data signal data may be applied to the second node n2 through the first transistor T1.

The data signal Data may be applied in two forms. According to an embodiment, a data signal Data in a higher level than a common voltage Vcom may be applied. According to another embodiment, a data signal Data in a lower level than a common voltage Vcom may be applied. A data signal Data in a higher level than the common voltage Vcom and a data signal Data in a lower level than the common voltage may be alternately applied to the data lines DL1 to DLm. The data signal Data may be applied until a fourth time t4.

The data signal Data is applied to the reflective element D1 connected to the third node n3 through the second transistor T2. A data signal Vdata is a signal for driving the reflective element D1. The reflective element D1 may be driven by a voltage difference of the data signal Vdata and the second control signal Vcont, which are applied to the both ends.

Then, the data signal Vdata is applied to the other end of the capacitor Cst and the gate terminal of the third transistor T3. The capacitor Cst may be charged by the second control signal Vcont applied to the one end and the data signal Vdata may applied to the other end. The third transistor T3 may be turned by the data signal data. However the second control signal Vs_bar applied to the gate terminals of the fourth and fifth transistors T4 and T5 is in a low level, the emissive element circuit 320*a* is not driven. Accordingly, the fifth transistor T5 may prevent a malfunction of the emissive element circuit 320*a*. Additionally, at this point, when the power voltage VDD is set to a low level, since current does not flow even if a gate voltage of the third transistor t3 is applied, this may also prevent a malfunction of the emissive element circuit 320*a*.

At a third time t3, the last applied nth scan signal Vscan n changes from a high level into a low level. Then, at a fifth time t5, the first and second control signals Vs and Vcont change from a high level into a low level.

Figure 6:
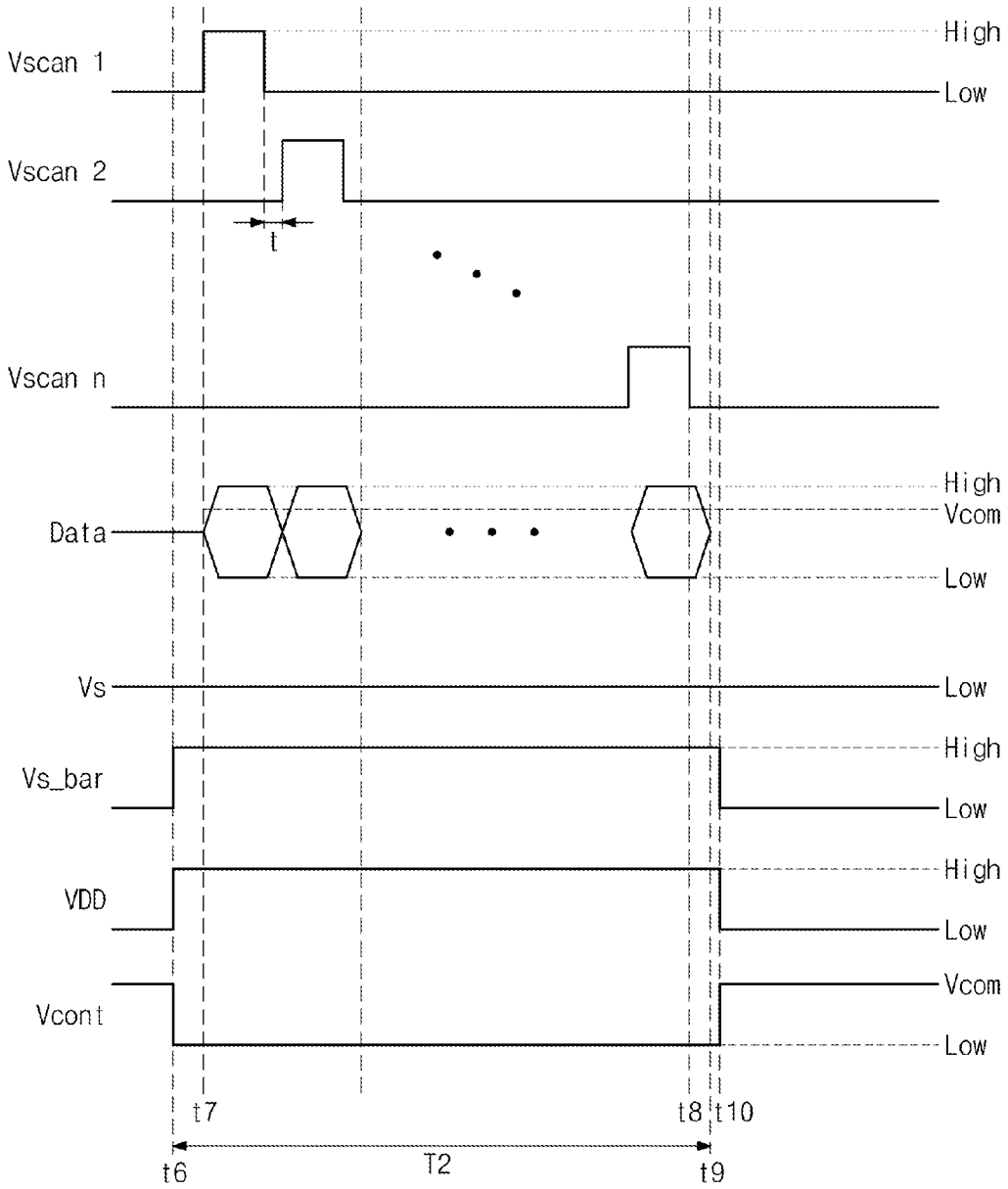
FIG. 6 is a timing diagram illustrating a signal applied to a pixel in order to implement an emissive mode according to an embodiment.
Figure 7:
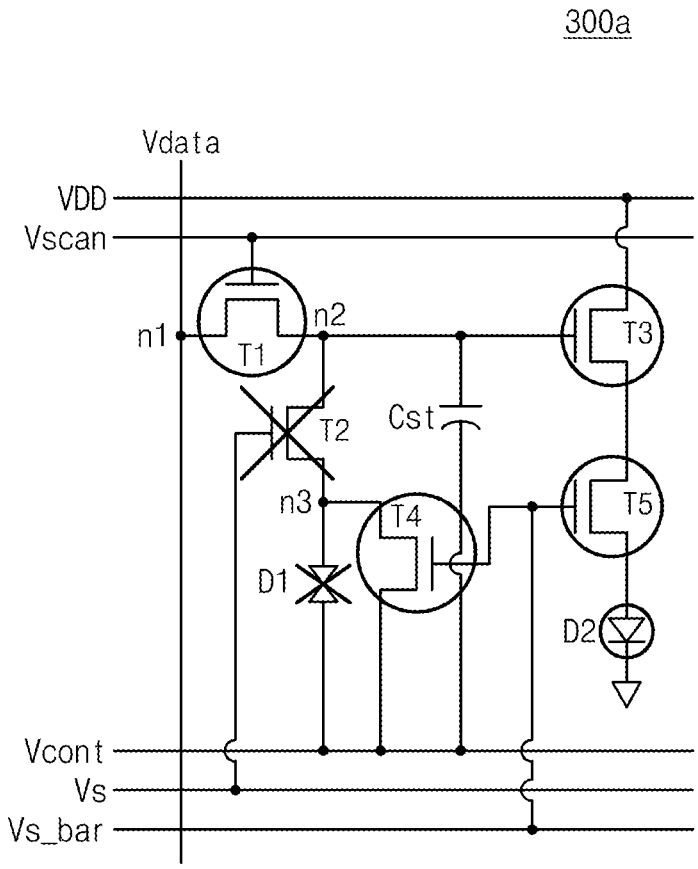
FIG. 7 is a circuit diagram illustrating an operation of an emissive element in a pixel of FIG. 3.

FIG. 6 is a timing diagram illustrating a signal applied to a pixel in order to implement an emissive mode according to an embodiment. FIG. 7 is a circuit diagram illustrating an operation of an emissive element in a pixel of FIG. 3.

Referring to FIGS. 6 and 7, a pixel 300*a* may drive an emissive element circuit 320*a* in a T2 section. At a sixth time t6, a power voltage VDD of a high level may be applied to a third transistor t3. Then, a third control signal Vs_bar of a high level may be applied to gate terminals of fourth and fifth transistors T4 and T5. Accordingly, the fourth and fifth transistors T4 and T5 may be turned by the third control signal Vs_bar. Additionally, when the fourth transistor T4 may be turned on, a second control signal Vcont of a low level may be applied to the both ends of the reflective element D1. Since the same voltage is applied to the both ends of the reflective element D1, the reflective element D1 is not driven.

At a seventh time t7, scan signals Vscan 1 to Vscan n of a high level may be sequentially applied through the gate lines GL1 to GLn. Accordingly, the scan signals Vscan 1 to Vscan n may be sequentially applied to the gate terminal of the first transistor T1 included in each of the pixels PX11 to PXnm. The scan signals Vscan 1 to Vscan n may be sequentially applied at an interval of a predetermined time t. Then, the scan signals Vscan 1 to Vscan n may be sequentially applied until an eighth time t8. When the first transistor T1 may be sequentially turned on by the scan signals Vscan 1 to Vscan n, a data signal Vdata may be applied to the gate terminal of the third transistor T3 through the second node n2.

The data signal Data may be applied in two forms. According to an embodiment, a data signal Data in a higher level than a common voltage Vcom may be applied. According to another embodiment, a data signal Data in a lower level than a common voltage Vcom may be applied. A data signal Data in a higher level than the common voltage Vcom and a data signal Data in a lower level than the common voltage may be alternately applied to the data lines DL1 to DLm. The data signal data may be applied until a ninth time t9. When the third transistor T3 is turned on by the data signal data, the power voltage VDD is applied to the emissive element D2 through the third and fifth transistors T3 and T5. Then, in relation to the pixel 300*a*, even if the first transistor T1 is turned off as a scan signal Vscan changes from a high level into a low level, a voltage applied to the gate of the third transistor T3 may be maintained constant through the discharge of the capacitor Cst.

For example, when the second scan signal of a high level is applied, the first scan signal Vscan 1 changes from a high level into a low level. Accordingly, the first transistor T1 included in each of pixels connected to the first gate line GL1 is turned off, so that the supply of the data signal is stopped. However, a voltage applied to the gate of the third transistor T3 is maintained constant through the discharge of the capacitor Cst.

At the eighth time t8, the scan signal Vscan changes from a high level into a low level. Then, at a tenth time t10, the second control signal Vs changes from a high level into a low level.

When the emissive element circuit 320*a* is driven, by applying the same voltage to the both ends of the emissive element D1, a malfunction of the reflective element D1 may be prevented.

Figure 8:
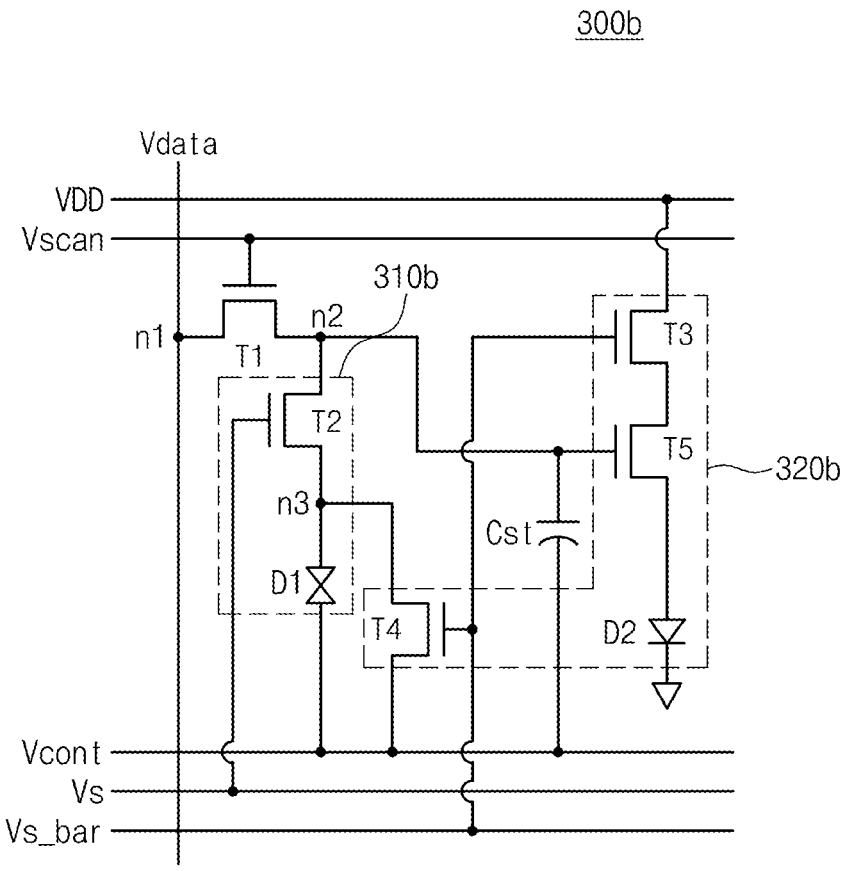
FIG. 8 is a circuit diagram illustrating a pixel of FIG. 1 in detail according to another embodiment.

FIG. 8 is a circuit diagram illustrating a pixel of FIG. 1 in detail according to another embodiment. Referring to FIG. 8, a pixel 300*b* may include a reflective element circuit 310*b* and an emissive element circuit 320*b*.

A first transistor T1 is a transistor for driving the pixel 300*b*. The first transistor T1 is connected between a first node n1 and a second n2. According to a scan signal Vscan applied to the gate terminal of the first transistor T1, a data signal Vdata applied to the first node n1 may be delivered to a reflective element circuit 310*b* or an emissive element circuit 320*b*, which is connected to the second node n2.

The reflective element circuit 310*b* may include a second transistor T2 and a reflective element D1. The second transistor T2 is connected between the second node n2 and a third node n3. Then, one end of the reflective element D1 is connected to the third node n3 and the second control signal Vcont is applied to the other end. According to a first control signal Vs applied to the gate terminal of the second transistor T2, a data signal data may be delivered to the reflective element D1.

The emissive element circuit 320*b* may include third to fifth transistors T3 to T5 and an emissive element D2. According to a third control signal Vs_bar applied to the gate terminal, the third transistor T3 may deliver a power voltage VDD to the fifth transistor T5.

Then, the forth transistor T4 maintains voltages at the both ends of the reflective element D1 to be the same according to the third control signal Vs_bar applied to the gate terminal. The fifth transistor T5 delivers the power voltage VDD to the emissive element D2 according to the data signal data applied to the gate terminal.

A capacitor Cst is connected to the second node n2. When the emissive element circuit 320*b* is driven, the capacitor Cst may allow a voltage applied to a gate of the third transistor T3 to be constant. A detailed driving method of the pixel 300*b* will be described with reference to FIGS. 10 to 12.

Figure 9:
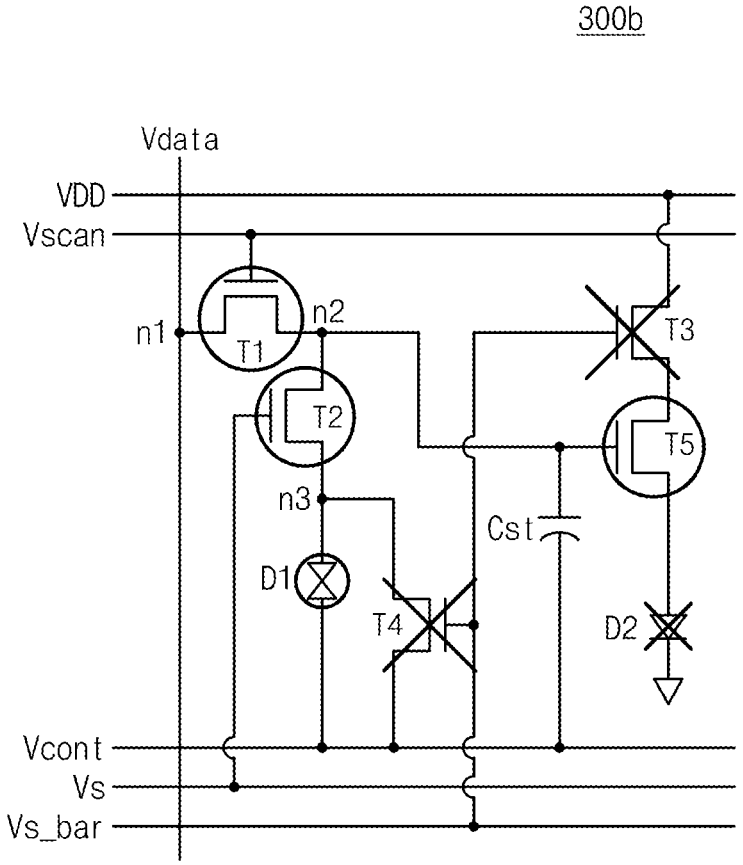
FIG. 9 is a circuit diagram illustrating an operation of a reflective element in a pixel of FIG. 8.

FIG. 9 is a circuit diagram illustrating an operation of a reflective element in a pixel of FIG. 8. Referring to FIGS. 9 and 4, FIG. 9 is a view illustrating an operation of a pixel 300*b* in the T1 section shown in FIG. 4.

In the T1 section, the pixel 300*b* drives the reflective element circuit 310*b*. At the first time t1, a first control signal Vs of a high level is applied to the gate terminal of a second transistor T2. Accordingly, the second transistor T2 is turned on by the first control signal Vs. Then, a second control signal Vcont is applied to one ends of a capacitor Cst and a reflective element D1. At this point, a voltage level of the second control signal Vcont may rise to a common voltage Vcom.

At the second time t2, scan signals Vscan 1 to Vscan n of a high level are sequentially applied to the gate lines GL1 to GLn, respectively. Accordingly, the scan signals Vscan 1 to Vscan n are sequentially applied to the gate terminal of the first transistor T1 through the gate lines GL1 to GLn of the pixels PX11 to PXnm. The scan signals Vscan 1 to Vscan n are sequentially applied at an interval of a predetermined time t. Then, the scan signals Vscan 1 to Vscan n are sequentially applied until the third time t3. When the first transistor T1 is turned on by the scan signals Vscan 1 to Vscan n, a data signal Vdata is sequentially applied through the data lines DL1 to DLm. The data signal data may be applied in different levels to each of the data lines DL1 to DLm. The data signal data is applied to the second node n2 through the first transistor T1.

The data signal Data may be applied in two forms. According to an embodiment, a data signal Data in a higher level than the common voltage Vcom may be applied. According to another embodiment, a data signal Data in a lower level than the common voltage Vcom may be applied. A data signal Data in a higher level than the common voltage Vcom and a data signal data in a lower level than the common voltage may be alternately applied to the data lines DL1 to DLm. The data signal Data may be applied until the fourth time t4.

The data signal Data is applied to the reflective element D1 connected to the third node n3 through the second transistor T2. Accordingly, the reflective element D1 may be driven by a voltage difference of the data signal Vdata and the second control signal Vcont, which are applied to the both ends.

Then, the data signal data is applied to the other end of the capacitor Cst and the gate terminal of the fifth transistor T5. The capacitor Cst is charged by the second control signal Vcont applied to the one end and the data signal Vdata applied to the other end. The fifth transistor T5 is turned by the data signal data but since the third control signal Vs_bar applied to the gate terminals of the third and fourth transistors T3 and T4 is in a low level, the emissive element circuit 320*a* is not driven. Accordingly, the fifth transistor T5 may prevent a malfunction of the emissive element circuit 320*a*. Additionally, at this point, when the power voltage VDD is set to a low level, since current does not flow even if a gate voltage of the third transistor t3 is applied, this may also prevent a malfunction of the emissive element circuit 320*a*.

At the third time t3, the last applied nth scan signal Vscan n changes from a high level into a low level. Then, at the fifth time t5, the first control signal Vs changes from a high level into a low level.

Figure 10:
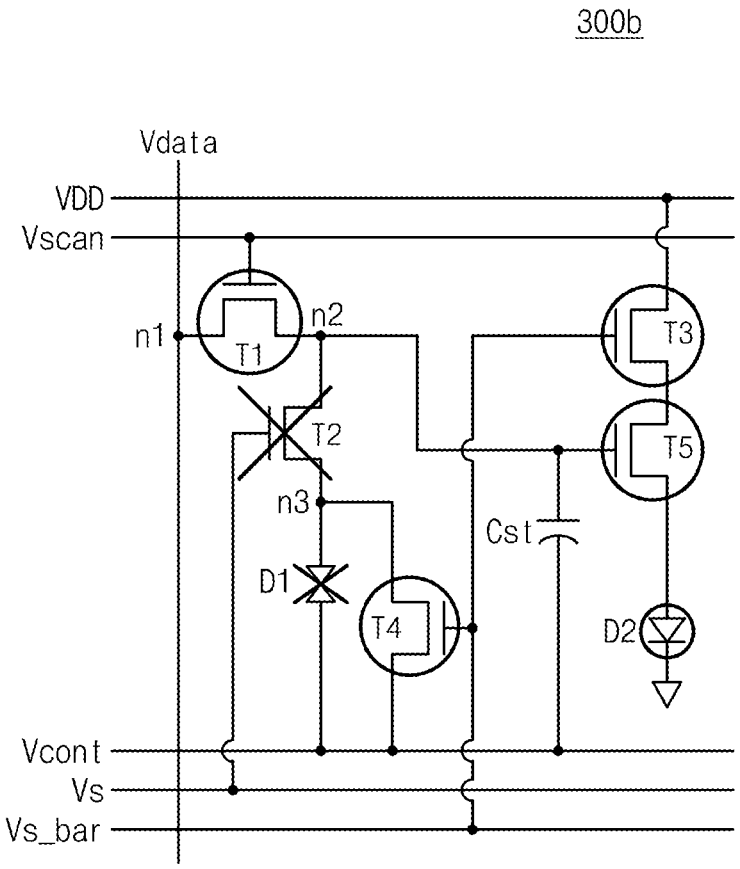
FIG. 10 is a circuit diagram illustrating an operation of an emissive element in a pixel of FIG. 8.

FIG. 10 is a circuit diagram illustrating an operation of an emissive element in a pixel of FIG. 8. Referring to FIGS. 10 and 6, FIG. 10 is a view illustrating an operation of a pixel in the T2 section shown in FIG. 6.

In the T2 section, the pixel 300*b* drives the emissive element circuit 320*b*. At the sixth time t6, a power voltage VDD of a high level is applied to a third transistor t3. Then, a second control signal Vcont of a low level is applied to one end of the reflective element D1, one end of the fourth transistor T4, and one end of the capacitor Cst. Then, a third control signal Vs_bar of a high level is applied to the gate terminals of the third and fourth transistors T3 and T4. The third and fourth transistors T3 and T4 are turned by the third control signal Vs_bar.

At the seventh time t7, scan signals Vscan 1 to Vscan n of a high level are sequentially applied to the gate lines GL1 to GLn, respectively. The scan signals Vscan 1 to Vscan n are sequentially applied to the gate terminal of the first transistor T1 included in each of the pixels PX11 to PXnm. When the first transistor T1 is turned on by the scan signals Vscan 1 to Vscan n, a data signal Vdata is applied to the gate terminal of the fifth transistor T5 through the second node n2.

When the fifth transistor T3 is turned on by the data signal data, the power voltage VDD is applied to the emissive element D2 through the third and fifth transistors T3 and T5. In relation to the pixel 300*a*, even if the first transistor T1 is turned off as a scan signal Vscan changes from a high level into a low level, a voltage applied to the gate of the third transistor T3 may be maintained constant through the discharge of the capacitor Cst.

Additionally, when the fourth transistor T4 is turned on, a second control signal Vcont of a low level is applied to the both ends of the reflective element D1. Accordingly, since voltages at the both ends of the reflective element D1 are the same, the reflective element D1 is not driven.

Figure 11:
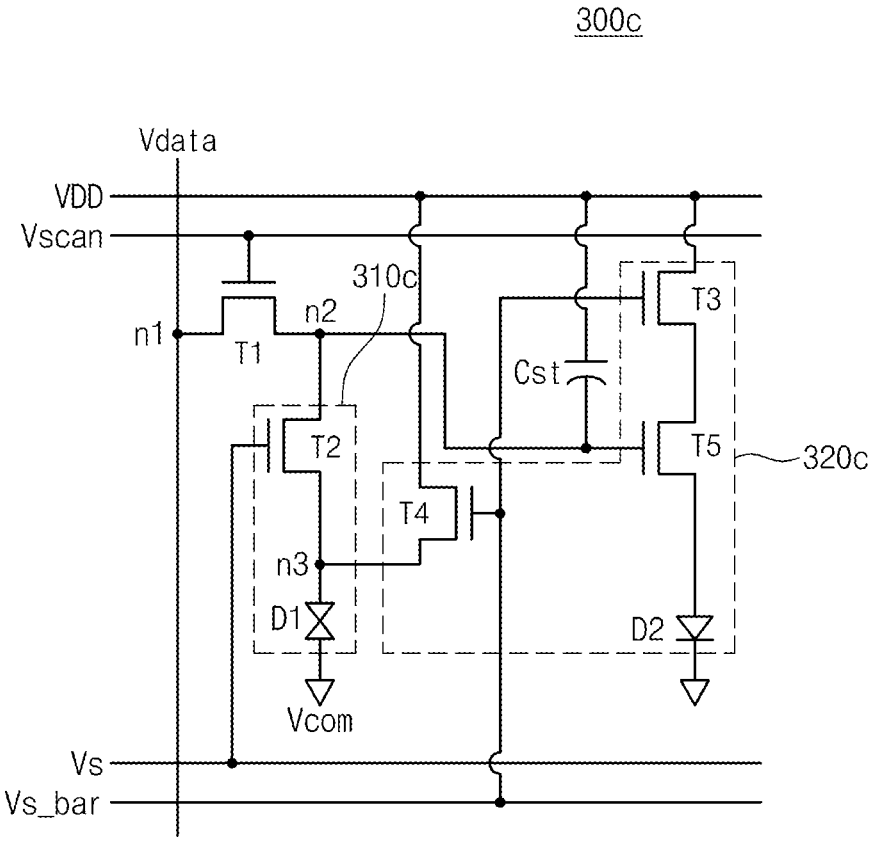
FIG. 11 is a circuit diagram illustrating a pixel of FIG. 1 in detail according to another embodiment.

FIG. 11 is a circuit diagram illustrating a pixel of FIG. 1 in detail according to another embodiment of the inventive concept. Compared to the pixel 300*b* of FIG. 8, a pixel 300*c* of FIG. 11 does not receive a first control signal Vcont. One end of the fourth transistor T4 is connected to the third node n3 and the power voltage VDD is applied to the other end. Then, one end of the capacitor Cst is connected to the second node n2 and the power voltage VDD is applied to the other end. A detailed driving method will be described with reference to FIGS. 12 to 15.

Figure 12:
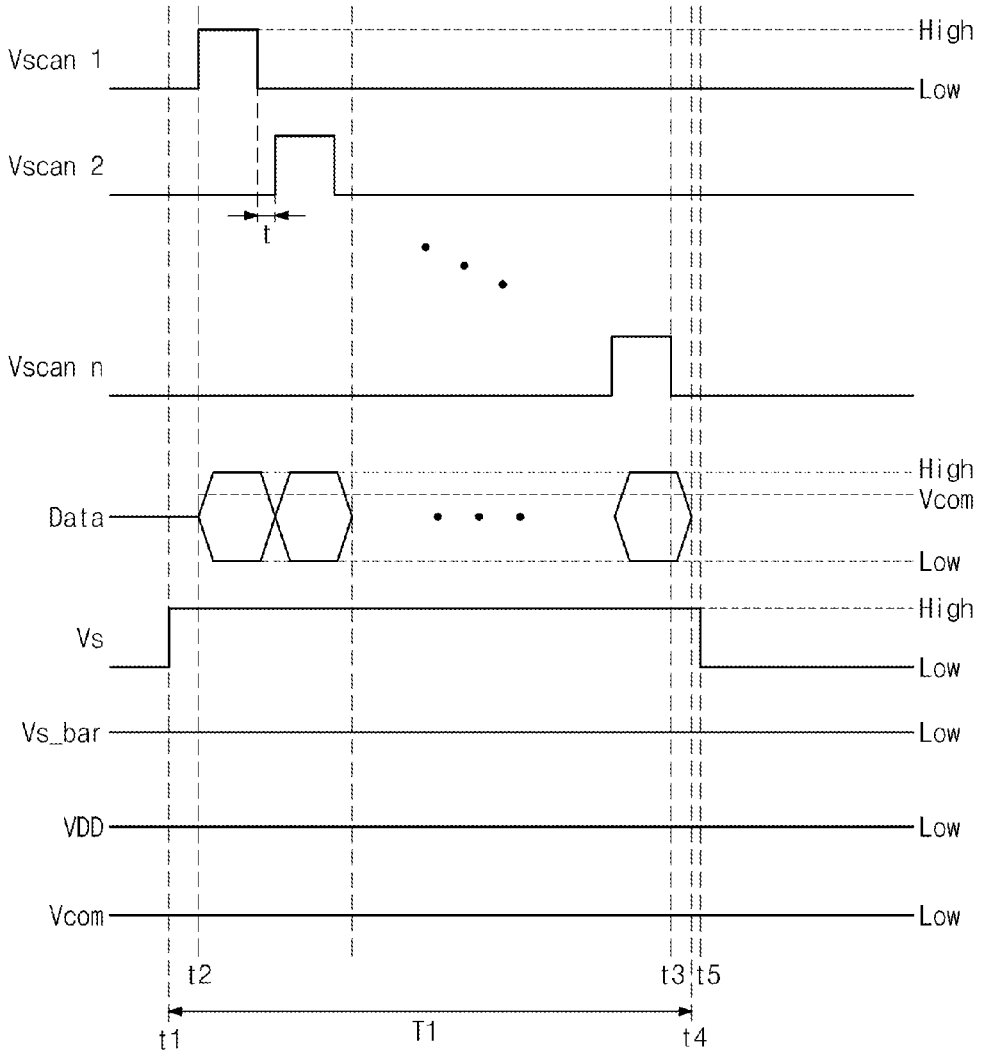
FIG. 12 is a timing diagram illustrating a signal applied to a pixel in order to implement a reflective mode according to another embodiment.
Figure 13:
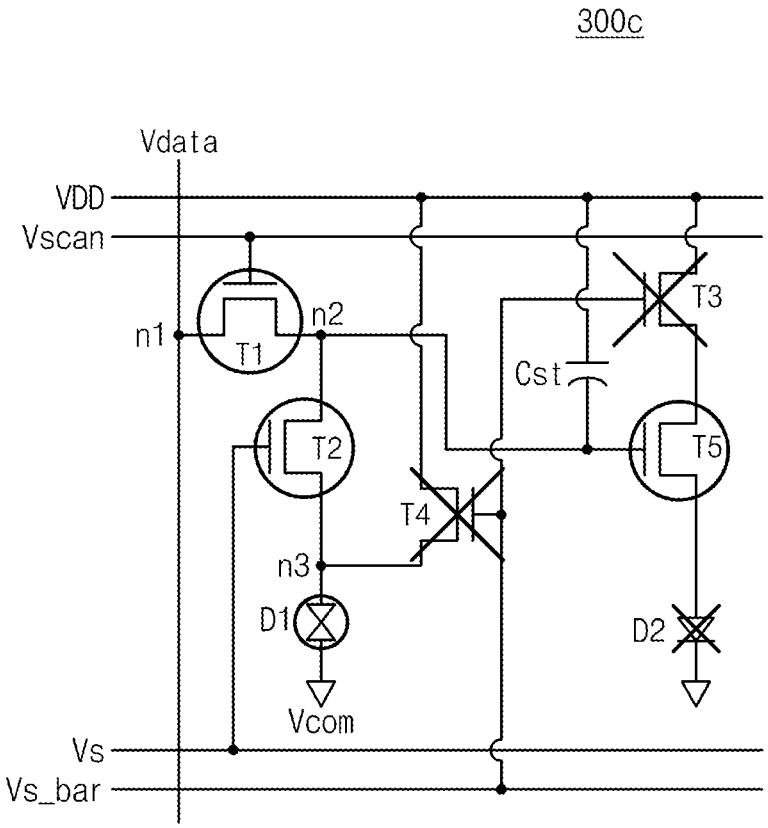
FIG. 13 is a circuit diagram illustrating an operation of a reflective element in a pixel of FIG. 12.

FIG. 12 is a timing diagram illustrating a signal applied to a pixel in order to implement a reflective mode according to another embodiment. FIG. 13 is a circuit diagram illustrating an operation of a reflective element in a pixel of FIG. 12.

Referring to FIGS. 12 and 13, a pixel 300*c* drives a reflective element circuit 310*c* in a T1 section. At a first time t1, a first control signal Vs of a high level is applied to the gate terminal of a second transistor T2. The second transistor T2 is turned on by the first control signal Vs.

At a second time t2, scan signals Vscan 1 to Vscan n of a high level are sequentially applied to the gate lines GL1 to GLn, respectively. The scan signals Vscan 1 to Vscan n are applied to the gate terminal of the first transistor T1 included in each of the pixels PX11 to PXnm. Accordingly, the scan signals Vscan 1 to Vscan n are sequentially applied to the gate terminal of the first transistor T1 at an interval of a predetermined time t through the gate lines GL1 to GLn of the pixels PX11 to PXnm. The scan signals Vscan 1 to Vscan n are sequentially applied until a third time t3. When the first transistor T1 is turned on by the scan signals Vscan 1 to Vscan n, a data signal data is sequentially applied through the data lines DL1 to DLm. The data signal data may be applied in different levels to each of the data lines DL1 to DLm. The data signal data is applied to the second node n2 through the first transistor T1.

The data signal Data may be applied in two forms. According to an embodiment, a data signal Data in a higher level than the common voltage Vcom may be applied. According to another embodiment, a data signal Data in a lower level than the common voltage Vcom may be applied. A data signal Data in a higher level than the common voltage Vcom and a data signal Data in a lower level than the common voltage may be alternately applied to the data lines DL1 to DLm. The data signal Data may be applied until the fourth time t4.

The data signal Data is applied to the reflective element D1 connected to the third node n3 through the second transistor T2. Accordingly, the reflective element D1 may be driven by a voltage difference of the data signal Vdata and the second control signal Vcont, which are applied to the both ends. Then, the data signal data is applied to the other end of the capacitor Cst and the gate terminal of the fifth transistor T5. The capacitor Cst is charged by the power voltage VDD applied to the one end and the data signal data applied to the other end. The fifth transistor T5 is turned by the data signal data but since the third control signal Vs_bar applied to the gate terminals of the third and fourth transistors T3 and T4 is in a low level, the emissive element circuit 320*c* is not driven. Accordingly, the fifth transistor T5 may prevent a malfunction of the emissive element circuit 320*a*. Then, since the power voltage VDD applied to one end of the capacitor Cst is in a low level, current does not flow through the third transistor t3, so that it may prevent a malfunction of the emissive element circuit 320*a*.

At a third time t3, the last applied nth scan signal Vscan n changes from a high level into a low level. Then, at a fifth time t5, the first control signal Vs changes from a high level into a low level.

Lastly, as shown in FIG. 13, in order for an accurate reflection operation of the reflective element circuit 310*c*, instead of the power voltage VDD, the common voltage Vcom may be applied. Specifically, when the common voltage Vcom is applied to the power supply VDD, current may flow through the third transistor T3 of the emissive element circuit 320*c* but current applied to the emissive element circuit 320*c* through the third transistor T5 may be blocked. Accordingly, when the reflective element circuit 310*c* operates, even if the power voltage VDD is set to the common voltage Vcom, malfunction may be prevented.

Figure 14:
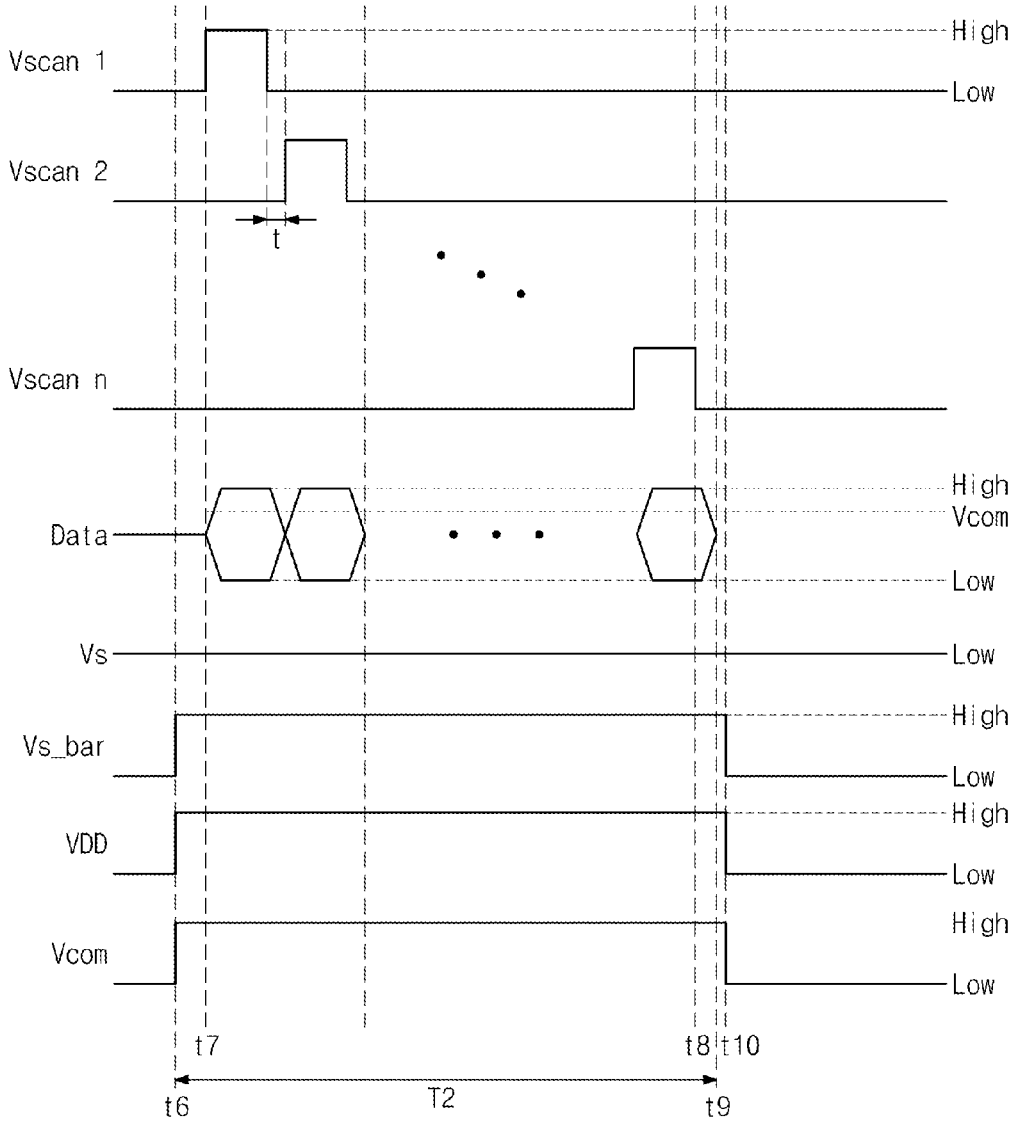
FIG. 14 is a timing diagram illustrating a signal applied to a pixel in order to implement an emissive mode according to another embodiment.
Figure 15:
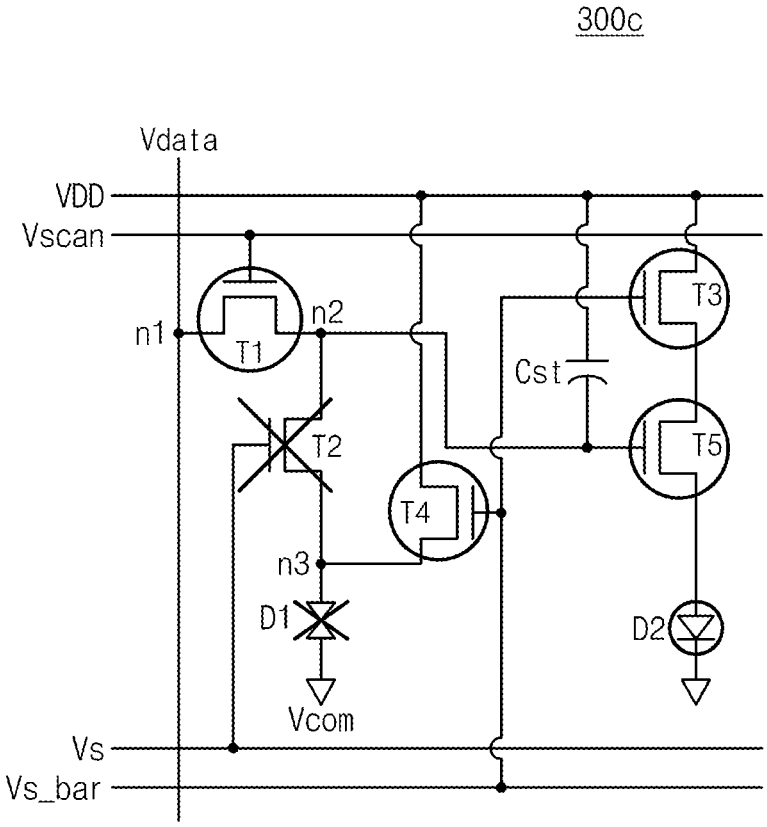
FIG. 15 is a circuit diagram illustrating an operation of an emissive element in a pixel of FIG. 11.

FIG. 14 is a timing diagram illustrating a signal applied to a pixel in order to implement an emissive mode according to another embodiment. FIG. 15 is a circuit diagram illustrating an operation of an emissive element in a pixel of FIG. 11.

Referring to FIGS. 14 and 15, a pixel 300*a* drives an emissive element circuit 320*a* in a T2 section. At the fifth time t5, a power voltage VDD of a high level is applied to a third transistor t3. Then a common voltage signal Vcom of a high level is applied to one end of the reflective element D1. Then, a third control signal Vs_bar of a high level is applied to the gate terminals of fourth and fifth transistors T4 and T5. Accordingly, the fourth and fifth transistors T4 and T5 are turned by to the third control signal Vs_bar. Additionally, when the fourth transistor T4 is turned on, a common voltage signal Vcom of a high level is applied to one end of the reflective element D1 and a power voltage VDD of a high level is applied to the other end. Herein, the sizes of a power voltage VDD of a high level and the common voltage signal Vcom may be the same. Accordingly, since the same voltage is applied to the both ends of the reflective element D1, the reflective element D1 is not driven.

At a seventh time t7, scan signals Vscan 1 to Vscan n of a high level are applied to the gate lines GL1 to GLn. The scan signals Vscan 1 to Vscan n are applied to the gate terminal of the first transistor T1 included in each of the pixels PX11 to PXnm. The scan signals Vscan 1 to Vscan n are sequentially applied until the third time t3. When the first transistor T1 is turned on by the scan signals Vscan 1 to Vscan n, a data signal data is applied to the gate terminal of the fifth transistor T5 through the second node n2.

The data signal Data may be applied in two forms. According to an embodiment, a data signal Data in a higher level than the common voltage Vcom may be applied. According to another embodiment, a data signal Data in a lower level than the common voltage Vcom may be applied. A data signal Data in a higher level than the common voltage Vcom and a data signal Data in a lower level than the common voltage may be alternately applied to the data lines DL1 to DLm. The data signal Data may be applied until a ninth time t9.

When the third transistor T3 is turned on by the data signal Vdata, the power voltage VDD is applied to the emissive element D2 through the third and fifth transistors T3 and T5. Then, a voltage applied to the gate of the third transistor T3 is maintained constant through the discharge of the capacitor Cst.

At an eighth time t8, the last applied nth scan signal Vscan n changes from a high level into a low level. Then, at a tenth time t10, the power voltage VDD and the common voltage signal Vcom change from a high level into a low level.

According to an embodiment, provided is a display device for selectively driving a reflective element circuit or an emissive element circuit by a switch transistor depending on an external illumination environment. Additionally, a reflective element circuit and an emissive element circuit may share an input line of control signals by a switch transistor. Accordingly, a pixel of a display device may have an improved aperture ratio due to a reduced wiring area.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display panel comprising pixels connected to gate lines and data lines, wherein each of the pixels comprises:

a first transistor connected between a corresponding data line among the data lines and a first node, and configured to deliver a data signal of the corresponding data line to the first node in response to an input signal received through a corresponding gate line among the gate lines;

a reflective element circuit connected to the first node, and configured to implement a reflective mode in response to the delivered data signal of the first node when a first mode selection signal indicates the reflective mode;

an emissive element circuit connected to a second node, and configured to implement an emissive mode in response to the delivered data signal of the first node when a second mode selection signal indicates the emissive mode; and a capacitor, one end of the capacitor being connected to the first node and an other end of the capacitor being applied with a control signal, and wherein the reflective element circuit comprises:

a second transistor connected between the first node and the second node, and configured to operate in response to the first mode selection signal; and a reflective element, one end of the reflective element being connected to the second node and an other end of the reflective element being supplied with the control signal.

2. The display panel of claim 1, wherein when the first transistor is turned on, the capacitor is charged by a voltage difference between the delivered data signal of the first node and the control signal, and wherein the capacitor maintains the delivered data signal of the first node when the first transistor is turned off.

3. The display panel of claim 1, wherein the emissive element circuit comprises:

a third transistor connected to the first node, one end of the third transistor being configured to receive a power voltage, the power voltage being delivered from one end of the third transistor to an other end of the third transistor in response to the delivered data signal of the first node;

a fourth transistor connected to the second node, and configured to apply the control signal to the second node in response to the second mode selection signal; and a fifth transistor connected to the other end of the third transistor, and configured to connect the other end of the third transistor to an emissive element in response to the second mode selection signal.

4. The display panel of claim 1, wherein the emissive element circuit comprises:

a third transistor configured to receive a power voltage, the power voltage being delivered from one end of the third transistor to an other end of the third transistor in response to the second mode selection signal;

a fourth transistor connected to the second node and configured to apply the control signal to the second mode in response to the second mode selection signal; and a fifth transistor connected to the other end of the third transistor and configured to connect the other end of the third transistor to an emissive element in response to the delivered data signal of the first node.

5. A display panel comprising pixels connected to gate lines and data lines, wherein each of the pixels comprises:

a first transistor connected between a corresponding data line among the data lines and a first node and configured to deliver a data signal of the corresponding data line to the first node in response to an input signal received through a corresponding gate line among the gate lines;

a reflective element circuit connected to the first node, and configured to implement a reflective mode in response to the delivered data signal of the first node when a first mode selection signal indicates the reflective mode;

an emissive element circuit connected to a second node, and configured to implement an emissive mode in response to the delivered data signal of the first node when a second mode selection signal indicates the emissive mode; and a capacitor, one end of the capacitor being supplied with a power voltage and an other end of the capacitor being connected to the first node, and wherein the reflective element circuit comprises:

a second transistor connected between the first node and the second node, and configured to operate in response to the first mode selection signal; and a reflective element one end of the reflective element being connected to the second node and an other end of the reflective element being supplied with a common voltage.

6. The display panel of claim 5, wherein the emissive element circuit comprises:

a third transistor configured to receive a power voltage, the power voltage being delivered from one end of the third transistor to an other end of the third transistor in response to the second mode selection signal;

a fourth transistor configured to apply the power voltage to the second node in response to the second mode selection signal; and a fifth transistor connected to the other end of the third transistor and configured to connect the other end of the third transistor to an emissive element in response to the delivered data signal of the first node.

7. The display panel of claim 5, wherein when the first transistor is turned on, the capacitor is charged by a voltage difference between the power voltage and the delivered data signal of the first node, and wherein the capacitor maintains the delivered data signal of the first node when the first transistor is turned off.

8. The display panel of claim 5, wherein a phase of the second mode selection signal is opposite to a phase of the first mode selection signal.

9. A display device comprising:

a display panel comprising pixels connected to gate lines and data lines;

a gate driving circuit connected to the display panel and the gate lines and configured to provide a gate signal to the pixels; and a data driving circuit connected to the display panel and the data lines and configured to provide a data signal to the pixels, wherein each of the pixels comprises:

a first transistor connected between a corresponding data line among the data lines and a first node, and configured to deliver a data signal of the corresponding data line to the first node in response to an input signal received through a corresponding gate line among the gate lines;

a reflective element circuit connected to the first node, and configured to implement a reflective mode in response to the delivered data signal of the first node when a mode selection signal indicates the reflective mode;

an emissive element circuit connected to a second node, and configured to implement an emissive mode in response to the delivered data signal of the first node when the mode selection mode indicates the emissive mode; and a capacitor, one end of the capacitor being connected to the first node and an other end of the capacitor being applied with a control signal, and wherein the reflective element circuit comprises:

a second transistor connected between the first node and the second node, and configured to operate in response to the first mode selection signal; and a reflective element, one end of the reflective element being connected to the second node and an other end of the reflective element being supplied with the control signal.

* * * * *